US005303774A

United States Patent [19]

Duhn et al.

[11] Patent Number: 5,303,774

[45] Date of Patent: Apr. 19, 1994

[54] RING SEAL PACKER

[75] Inventors: Jay C. Duhn; Rex E. Duhn; Kenneth D. Webster; Aaron B. Speirs, all of Bakersfield, Calif.

[73] Assignees: Duhn Oil Tool, Inc., Bakersfield, Calif.; Shell Western E & P, Inc., Houston, Tex.

[21] Appl. No.: 989,202

[22] Filed: Dec. 11, 1992

[51] Int. Cl.[5] ..... F21B 23/00; F21B 23/02

[52] U.S. Cl. ..... 166/191; 166/322

[58] Field of Search ..... 166/191, 82, 127, 272, 166/257, 115

[56] References Cited

U.S. PATENT DOCUMENTS

| | | | |
|---|---|---|---|
| 2,618,340 | 11/1952 | Lynd | 166/191 |
| 2,764,243 | 9/1956 | Page | 166/191 |
| 2,904,115 | 9/1959 | Turner | 166/191 |
| 3,659,648 | 5/1972 | Cobbs | 166/191 |
| 3,714,983 | 2/1973 | Wilson | 166/120 |
| 3,814,409 | 6/1974 | Prasse | 267/1.5 |
| 4,184,515 | 1/1980 | Streich et al. | 138/89 |
| 4,224,987 | 9/1980 | Allen | 166/120 |
| 4,271,903 | 6/1981 | Slagle, Jr. et al. | 166/129 |
| 4,569,396 | 2/1986 | Busico | 166/191 |
| 4,745,972 | 5/1988 | Bell et al. | 166/134 |
| 4,951,746 | 8/1990 | Setterberg, Jr. | 166/114 |

*Primary Examiner*—Ramon S. Britts
*Assistant Examiner*—Frank S. Tsay
*Attorney, Agent, or Firm*—Christie, Parker & Hale

[57] ABSTRACT

A ring seal packer is used for sealing the inside of a specified diameter of API tube. The cylindrical body of the ring seal packer has a pair of circumferential grooves and a pair of rigid seal rings are provided in each such groove. The two rings collectively occupy substantially the entire length of the groove, with no more than a small clearance at the ends for forming a small area orifice through which fluid may flow. Each of the rings has an outside diameter larger than the inside diameter of a specified size of API tube. A longitudinal slot in the ring permits it to collapse to a diameter that fits into the tube as it is pushed into the well. A tang and notch arrangement keeps the rings from rotating relative to each other so that the slots are kept out of alignment. The ring seal packer does not use any elastomeric sealing materials.

23 Claims, 2 Drawing Sheets

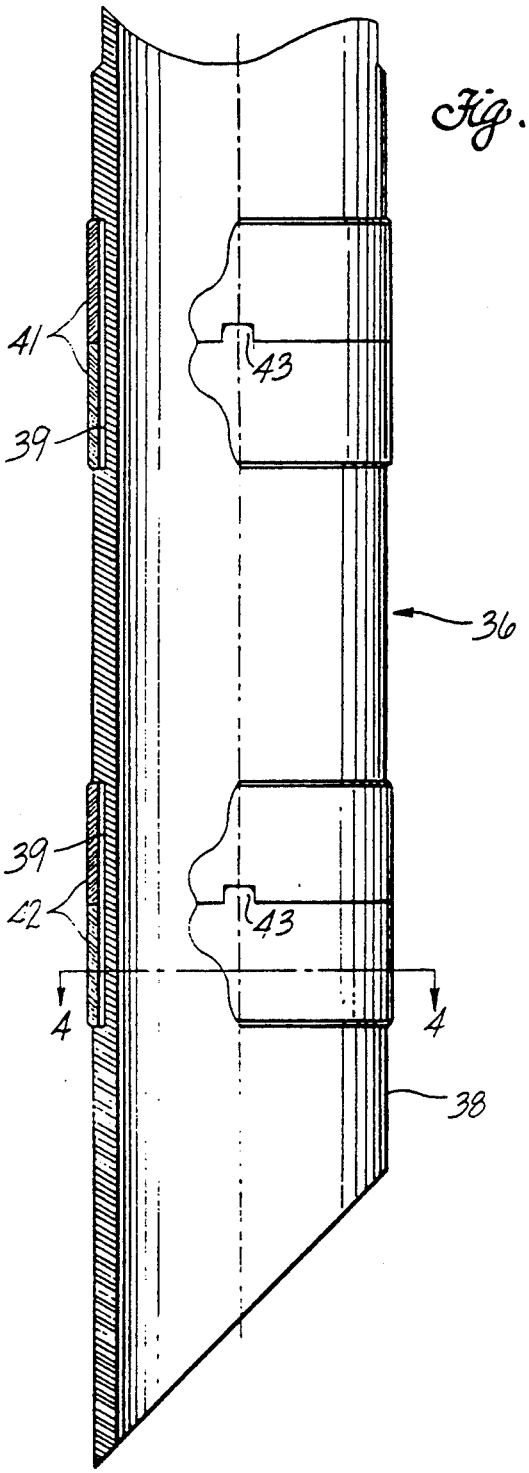
Fig. 3
Fig. 4
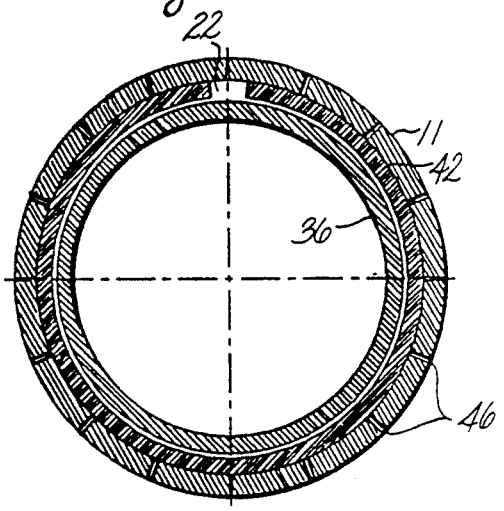

RING SEAL PACKER

BACKGROUND

A popular technique for secondary recovery of petroleum, or sometimes for initial recovery of what is known as heavy petroleum which is highly viscous, is by steam injection. A common technique used for secondary recovery is to have a pair of wells or a number of wells, with some of the wells being used for injecting high pressure, high temperature steam. Another set of wells is used for recovering the oil that is forced out of the rock formation by the steam. Steam not only provides pressure for pressing against the oil and causing it to flow from an injection well toward a production well, but also heats the oil, which lowers the viscosity and allows the oil to flow more readily through the rock formation to the production well.

Another technique for steam injection uses a single well. It is temporarily used for steam injection to heat the fluids in the formation. Later the steam injection is discontinued and the heated oil begins to flow to the well due to the pressure differential as oil is produced. Single wells may also use steam injection at one elevation and recover oil at a different elevation. The wells use downhole pumps or sucker rod pumps that withdraw the oil from the well.

A problem that occurs during steam injection is depletion of oil in the formation and flow of steam from the formation into the production well. The breakthrough of steam from what the industry refers to as a desaturated zone into the production well reduces the volume of production. Any flow of steam into the production well increases the pressure in the production well, thereby reducing the flow of oil. Furthermore, steam that enters the casing of the production well must be handled at the surface. The steam may be condensed and the water reclaimed or recycled for steam injection, in which case, the lost steam represents a substantial energy investment, and added emission of pollutants from the fuel burned to make the steam. Alternatively, the steam reaching the surface may be vented, not only representing an energy consumption, but also an environmental contamination.

It is therefore desirable to isolate the portion of the well in the desaturated zone to inhibit steam entry into the wellbore.

A number of sophisticated packers have been developed for the oil industry for introduction into the well tubing to block off portions of the tubing. These packers have had complicated mechanical and hydraulic arrangements for radially advancing slips against the tubing of the well and holding the packer in place. They often have elastomeric seals that are expanded against the inside wall of the tubing to provide the seal against the tubing. Because of the sophisticated nature of the packers they are expensive. In addition, the elastomeric packers may deteriorate rapidly in use because of the high temperatures encountered during steam injection. Steam is sometimes injected at temperatures as high as 500° to 800° F. which may cause failure due to seal breakdown.

It is therefore desirable to provide a "self-deploying" packer or seal for an oil well that can be readily inserted into the well without sophisticated equipment, is economical to manufacture and can be used at the high temperatures involved in steam injection.

BRIEF SUMMARY OF THE INVENTION

Thus, there is provided in practice of this invention according to a presently preferred embodiment, a ring seal packer for sealing a specified diameter of API tubing with at least a pair of rigid seal rings. The ring seal packer has a cylindrical mandrel with at least one circumferential groove. A pair of seal rings are mounted in the groove with the two rings collectively occupying substantially the full length of the groove. Each of the rings has an outside diameter larger than the inside diameter of the specified size of API tubing. A longitudinal slot in each of the rings permits the ring to collapse to a diameter that fits into the tubing, and means are provided for keeping the two slots out of alignment to avoid a leak path. Preferably two or more pairs of rings in separate grooves are used in a ring seal packer.

This provides the only known self-deploying packer which does not require mechanical or hydraulic means for deployment when installed in a well.

BRIEF DESCRIPTION OF THE DRAWINGS

These and other features and advantages of this invention will be appreciated as the same becomes better understood by reference to the following detailed description when considered in connection with the accompanying drawings wherein:

FIG. 3 is a side view partially cut away in longitudinal cross section of another embodiment of ring seal packer; and FIG. 4 is a transverse cross section through the ring seal packer illustrated in FIG. 3 along line 4—4.

DESCRIPTION

Figure 1:
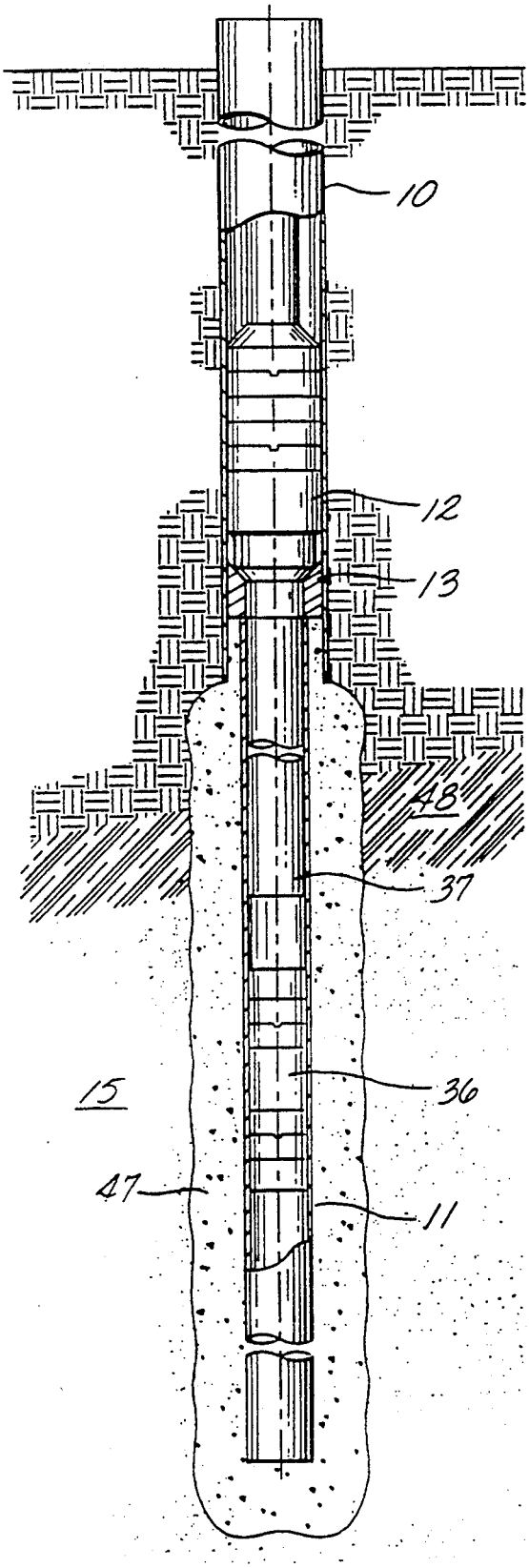
FIG. 1 illustrates in longitudinal cross section two ring seal packers installed in the casing of a well.

An oil well has a surface casing 10 which is a steel pipe extending from the ground surface down to near a production zone. In the production zone various techniques are used for producing the oil from a production well or injecting steam in an injection well. A technique as illustrated in FIG. 1 employs a steel tube 11 which extends from below the surface casing into an enlarged portion of the oil well bore. A portion of the tube, usually referred to as a liner, is perforated for permitting production fluids to flow into the well. Gravel is frequently packed around the well liner to provide a high porosity region between the liner and the surrounding rock formation or reservoir 15 from which the oil is being produced. For such production the liner normally has slits through the walls in the order of 0.02 to 0.1 inch wide and two inches long through which well fluids may flow.

Both the tubing and casing employed for oil wells are selected from standard tube sizes specified by the American Petroleum Institute. The standard sizes of API tubing have known inside diameters so that the drillers and operators of oil wells can have known diameters of holes through which they must conduct the oil recovery operations. The well seal tools or ring seal packers provided in practice of this invention are designed for use with specific sizes of API tubing. For example, a specific ring seal packer may be designed for use with 5½ inch diameter tubing having a weight of 17 pounds per foot. That tubing has a specified inside diameter and the outside diameter of the ring seal packer is designed to be used with that size tube only.

Figure 2:
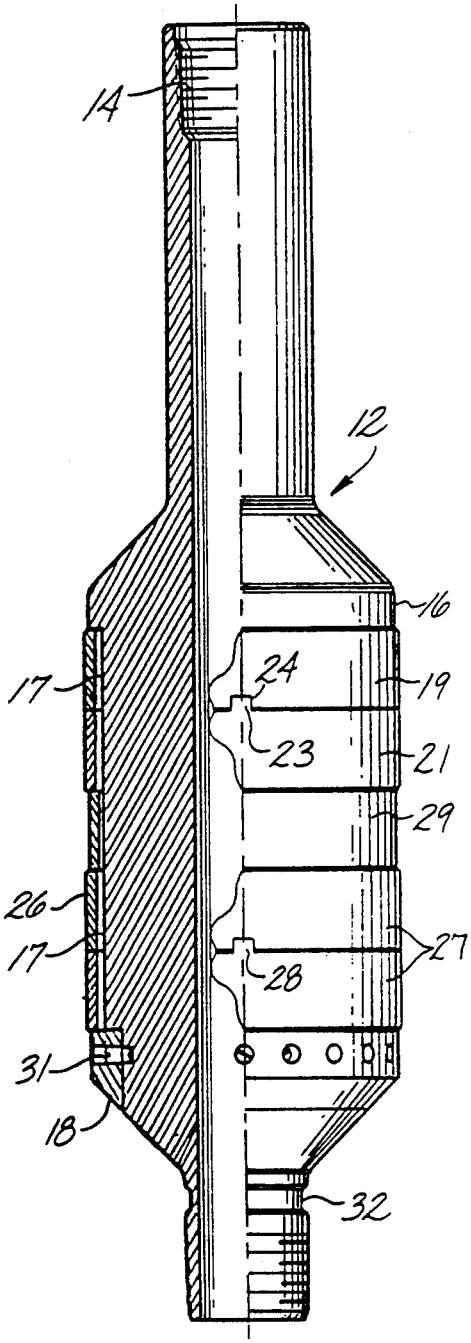
FIG. 2 is a side view partially cut away in longitudinal cross section of one embodiment of ring seal packer constructed according to principles of this invention.

A ring seal packer 12 for use in the surface casing of an oil well is illustrated in FIGS. 1 and 2. This upper ring seal packer is lowered through the casing until it seats against a conventional liner hanger or lead seal adapter 13 between the surface casing and well tubing. The upper end of the ring seal packer has a threaded "box" 14 for attaching onto the end of production tubing lowered into the well. A ring seal packer may be welded into production tubing. The production tube is used for inserting the ring seal packer into the well. The main body or mandrel 16 is tapered at the bottom to avoid entry restriction. A pair of circumferential grooves 17 are provided near the upper and lower ends of the mandrel. These grooves may be machined into the body of the mandrel as illustrated nearer the top of the body or one end of the groove may be closed by a separate sleeve, as is done with a shear ring 18 nearer the bottom of the mandrel which fits closely around the outside diameter of the body so that there is little, if any, fluid flow between the shear ring and the body.

In the upper groove, for example, there are a pair of rigid seal rings 19, 21 which collectively have a length only slightly smaller than the length of the groove. For example, in a typical embodiment the length of the groove is four inches and each ring has a nominal length of two inches. The total cumulative clearance between the ends of the rings and the ends of the groove is up to 0.010 inch. In other words, the stacked rings are only ten mils shorter than the length of the groove. Since the seal rings substantially completely fill the grooves, there is a good fluid restriction at the ends of the rings.

If the total clearance between the ends of a pair of rings and the ends of the groove is more than about ten mils, a significant amount of leakage can occur and additional sets of rings may be needed for achieving a desired degree of sealing. It is found that with no more than ten mils clearance, two pairs of rings are sufficient. Two sets of two rings each are more effective than one set of four seal rings would be. More pairs of rings may be used if desired for greater flow restriction.

The outside diameter of each of the rings is larger than the inside diameter of the selected API tube by 0.050 inch. A slot or split 22 (not shown in FIG. 2 but illustrated in the transverse cross section of FIG. 4 for the other embodiment of ring seal packer) is provided in each ring so that the ring can collapse to a smaller diameter as it is pressed through the tube during insertion into the well. Since the rest diameter of the ring is larger than the inside diameter of the tube, it fits tightly within the tube and provides a tight flow restriction against the tube. The ends of the rings are beveled slightly to promote collapse of the rings when they pass through the well bore.

The lower ring 21 has a rectangular tang 23 which fits into a complementary notch 24 in the upper ring 19. The tang and notch prevent the two rings from rotating relative to each other. The purpose of this is to keep the split in the upper ring from being aligned with the split in the lower ring since alignment would provide a path for fluid flow past the rings. Typically, a tang is formed 90° clockwise from the slot in the ring and a notch is formed 90° counter clockwise. When the seal rings are assembled, the slots are then 180° apart.

The same function could be performed by keying each of the rings to the mandrel, however, rotation of the rings relative to the mandrel is unimportant and it is more economical to fabricate the rings with a tang and notch than it is to provide special machining on the mandrel.

Relative rotation between the rings could be prevented by having notches in each ring and a separate key that fits into the notches. It is preferred, however, to have the means for preventing rotation integral with the rings so that there are no loose pieces.

Pairs of rings are used in the ring seal packer since each ring must have a slot to permit collapse of the ring as it fits into the tube. If only one seal ring were used, there would be a leak path through the slot. With two or more rings, the slots can be kept out of alignment for minimizing leakage through the slots.

The inside diameter of each ring and the outside diameter of the bottom of the corresponding groove 17 are dimensioned so that the maximum collapse of the ring as it is compressed by the tube as the ring seal packer is pushed into the well, is no smaller than the drift diameter of the tubing. Drift diameter is specified by API as a minimum dimension for the inside diameter of tubes so that other tubes or articles passed through the tube will fit.

Typically, the drift diameter is specified ⅛ inch smaller than the inside diameter of the specified tube. Thus, a typical ring in its fully expanded state is 0.050 inch larger than the nominal inside diameter of the tube with which it is to be used, and can collapse about 0.175 inch (on the diameter) when fully collapsed against the bottom of the groove. In other words, the inside diameter of the ring in its rest condition is 0.175 inch larger than the outside diameter of the groove in the mandrel.

Typically, the total depth of the groove is about the same as the wall thickness of the rings in the groove. Thus, the outside diameter of the body of the ring seal packer (or the outside diameter of a spacing sleeve 29 in the first embodiment) is about the same as the drift diameter of the tube in which it is to be used. The outside of the shear ring is also close to the drift diameter of the tube. The wall thickness of the rings should also be sufficient that when one ring is compressed and an adjacent ring is not, the rings cannot telescope one inside the other.

The inside diameter of each ring and outside diameter of the groove are such that when the ring is completely collapsed into the bottom of the groove, the ring is still within its elastic limit, that is, there is no plastic yield of the ring which would limit its return to an expanded condition against the inside wall of the tube.

The slot through each ring is made a little more than wide enough that the ring can collapse from its rest diameter to fit tightly in the bottom of the groove. Thus, for a typical embodiment where the outside diameter of the ring is 50 mils larger than the inside diameter of the tube and the drift diameter is ⅛ inch less than the nominal inside diameter of the tube. The slot has a minimum width of about 0.55 inch and is typically slightly wider so that when completely collapsed to the drift diameter there is still a gap of about 0.1 inch to give appreciable tolerance in the event the tube is actually smaller than the drift diameter.

By leaving an extra width in the gap of about 0.1 inch there is no problem with thermal expansion. As mentioned the ring seal packer may be called upon to sustain a seal at very high temperatures. The excess width of the gap minimizes the likelihood that a ring will stick in the well.

A second pair of rings 26, 27 is provided in the second groove 17 nearer the bottom of the mandrel. These rings also have a notch and tang arrangement 28 and slots (not shown) substantially identical to the upper pair of rings 19, 21. Usually the mandrel body is machined to separate each set of rings. However, in this embodiment a sleeve 29 separates the upper and lower pairs of rings. Preferably the sleeve fits rather closely around the outside diameter of the mandrel and has an outside diameter about the same as the drift diameter of tube with which the ring seal packer is to be used. This, in effect, converts the uniform outside diameter of the illustrated mandrel into a structure having two grooves 17. The assembly of rings and sleeve is held onto the mandrel by a shear ring 18 which is secured to the mandrel by a plurality of shear pins 31 threaded into the mandrel body.

When a ring seal packer is used in a well, corrosion may occur or sand may become packed between the ring seal packer and the surrounding tube. This may cause the seal to become stuck in the tube so that it cannot be readily withdrawn from the well by pulling on the tubing threaded into the mandrel. If that should occur, the shear pins are designed to fail at a tensile load of about ¾ of the yield strength of the tubing connecting the ring seal packer to the ground surface. In this way the main body of the ring seal packer can be withdrawn, leaving only the seal rings, sleeve and shear ring in the well to be fished or milled.

If desired, a reduced diameter neck 32 can be provided adjacent to the lower threaded end of the ring seal packer. Additional tubing is commonly threaded to the ring seal packer to extend further down the well and the reduced diameter neck serves as a weak point for breakage to permit the seal to be withdrawn if the lower tube is stuck. This leaves only the tube in the well for fishing or milling.

When a ring seal packer is fitted into a well tube, the seal rings fit tightly against the inside of the tube and effectively prevent appreciable fluid flow. Any fluid passing the ring seal packer must follow a labyrinthine path along the body of the mandrel below the lower rings, then inwardly between the end of a pair of rings and the end of the lower groove, along the annulus between the inside of the rings and the body of the mandrel in the groove, outwardly between the end of the lower pair of rings, then along the body of the mandrel between the pairs of rings, then inwardly, longitudinally and outwardly around the upper pair of rings, and finally along the upper part of the mandrel body.

The arrangement of rings fitted closely end-to-end in a groove on the body of the mandrel forms, in effect, a series of orifices resisting fluid flow. The small clearances between the ends of the rings and the ends of the groove each form an orifice. The space between the inside diameter of the rings and the outside diameter of the mandrel groove forms an orifice in series between those at the ends of the pair of rings. There is also an effective orifice in the annulus between the body of the mandrel and the inside of the tube both above and below the sets of rings and also between the sets of rings. The flow resistance through such a series of orifices can be calculated and the effect is not merely additive.

With dimensions as outlined above it has been calculated for a 6⅝ inch outside diameter ring seal packer the sealing efficiency of a pair of rings is about 75 to 80%. In other words, flow through the two-ring seal is reduced 75 to 80% relative to flow in the absence of a seal. When two pairs of rings are used in series as described and illustrated in FIG. 2, the ring seal packer is more than 95% efficient. Furthermore, corrosion or particles of sand, scale or the like which tend to plug the orifices can further improve efficiency.

FIGS. 1 and 3 illustrate a second embodiment of well sealing tool or ring seal packer 36, a transverse cross section of which is also illustrated in FIG. 4. This lower ring seal packer is welded at its upper end to a production tube 37 which extends from the bottom of the upper ring seal packer 12 through the perforated liner in the petroleum bearing reservoir 15. In this embodiment the body of the ring seal packer is little more than an open tube 38 which can be welded into the production tube. Alternatively, the ends of the ring seal packer tube may be threaded for connection into the production tube. The lower end of the ring seal packer forms a conventional diagonal mule shoe. In some embodiments, production tubing would extend below the lower seal.

A pair of grooves 39 are turned in the outer surface of the body of the ring seal packer 38. A pair of rigid seal rings 41 fit tightly in the upper groove and a similar pair of seal rings 42 fit in the lower groove. Each pair of rings has a tang and notch arrangement 43 to prevent rotation between the two rings of the pair. As described above, this keeps the slots 22 in the rings from being in alignment. Alignment of the slots would increase the effective area of the middle orifice formed by the rings.

Each pair of seal rings has small end-to-end clearance in the grooves and fits on the body of the mandrel and inside the tubing of the well the same as the rings in the first embodiment. The seal rings in this embodiment are positioned in the grooves by enlarging the rings from their rest diameter and sliding them longitudinally along the body of the seal until they snap into the respective grooves. Since the rings are not positioned in grooves created by a spacer and shear ring as described in the first embodiment, there must be sufficient elasticity of the ring to expand over the outside diameter of the body without permanent deformation. A ring thickness of about 0.2 inch in a ring with high yield strength is appropriate for providing sufficient elastic deformation.

The length of a pair of rings is at least sufficient to extend the full length of slots 46 in the perforated liner 11 of the well. As mentioned above, typical slot dimensions are about 0.02 to 0.1 inch wide and two inches long, with the long dimension extending longitudinally of the liner. This permits well fluids to flow into the well from the reservoir. Such slots would provide leakage past the seal rings of the ring seal packer if the total length of the rings were less than the length of the slots. Each ring is also made long enough that it will span the short gap between joints of pipe at a pipe coupling. The slots in the rings which permit them to collapse upon entering the tubing are about 180° out of alignment. This means that both such slots cannot align with slots in the liner and permit leakage past the ring seal packer.

The ring seal packer has no sophisticated moving parts and is readily machined without difficult set ups. For most service, the mandrel and rings can be fabricated of inexpensive mild steel. Where the rings are to be elastically sprung to fit onto the body of the ring seal packer as in the second embodiment, heat treated alloy steel may be used for the rings to give a greater elastic deformation below the yield strength of the material.

Rings made of fiberglass and high temperature resin, NEMA G-7, or of bronze, are also suitable.

In practice, one may position two ring seal packers in a well bore as illustrated in FIG. 1. In this embodiment an upper ring seal packer 12 closes off the surface casing and isolates the desaturated formation 47 in the reservoir 15 from the well annulus. The lower ring seal packer 36 is positioned below a desaturated zone 48 indicated in the drawing by stylized diagonal cross hatching. Such an arrangement is used in a production well spaced apart from a steam injection well. When such a ring seal packer is employed in an injection well only a single packer may be used, or multiple packers may be used for injecting steam into only a limited depth of the well.

The ring seal packers are positioned by connecting them in appropriate locations in the production tubing inserted into the well for recovering petroleum. They are simply pushed into the well bore and the seal rings collapse as described above so as to slide along the length of the well tubing. The ring seal packers are simply pushed in place to the desired elevation. Since the rings are elastically collapsed they are continually in near sealing engagement with the inside walls of the tubing. Fluid can flow past the seal only along the body of the seal, inwardly between the end of a groove and the end of a pair of seal rings, longitudinally inside the pair of rings, then outwardly between the other end of the groove and the other end of the pair of rings. The narrow gaps at the ends of the rings greatly restrict fluid flow. Such a seal is used in a situation where complete sealing is not necessary and some leakage is tolerable.

The ring seal packers may be withdrawn by reversing and simply pulling on the production tube.

When positioned as illustrated oil can flow from the reservoir into the gravel pack and then through the slots in the perforated liner. This oil is recovered from the well bore by a pump (not shown). Steam from the desaturated zone may also enter the well bore through the slots in the perforated liner. Flow of such steam into the production tube is largely prevented by the lower packer. Flow of such steam into the annulus between the production tube and the surface casing is largely prevented by the upper ring seal packer.

The ring seal packers have other uses such as isolating a portion of the well where sanding is a problem. Such a ring seal packer may be used in a gradually dropping reservoir for isolating the desaturated zone.

Such an inexpensive packing system has been found to be highly effective. It was used in a production well with about 60 barrels per day of gross production, about 30 barrels of which was petroleum. After installing such a ring seal packer, the gross production rose to about 160 to 170 barrels per day and the petroleum production increased three times to about 95 barrels per day. Conventional packers are inappropriate because of their cost and the limited lifetime of the elastomeric seals. No elastomers are required in the ring seal packer described herein since rigid seal rings are used.

The ring seal packer also provides substantial energy savings in steam injection operations. In several deployments of ring seal packers, casing pressure in production wells has been lowered from about 40 psi. to about 10 psi. The steam represented by this pressure difference does not need to be condensed and reheated, or vented to the atmosphere. The volume of steam that needs to be generated is thereby reduced substantially. Since less steam is generated, less fuel is burned and there is a reduction in the emissions from combustion. Emissions carried by vented steam are also reduced in fields where venting is permitted.

Although but two embodiments of ring seal packer constructed according to principles of this invention have been described and illustrated herein, many modifications and variations will be apparent to those skilled in the art. Some such variations have been mentioned in the preceding description. Such a ring seal packer may be made with a wicker at the lower end for insertion into a leaking lead seal adaptor. The upper end of such a ring seal packer would have conventional left hand running tool threads. Alternatively, the lower end of such a seal may be threaded to fit into a liner and substitute for a lead seal adaptor.

If desired three sets of rings may be used on the body of the ring seal packer. However, two sets of rings have been found to be sufficient. There may even be situations where a single pair of rings is enough. A variety of other configurations will also be apparent and it is therefore to be understood that within the scope of the appended claims, this invention may be practiced otherwise than as specifically described.

What is claimed is:

1. A ring seal packer comprising:

a tubular body;

a circumferential groove in an outside surface of the body;

a pair of rigid seal rings adjacent to each other in the groove, each of the rings having a longitudinally extending slot; and means for preventing relative rotation between the rings for maintaining the slots in adjacent rings out of axial alignment with each other.

2. A ring seal packer as recited in claim 1 further comprising:

a second circumferential groove longitudinally spaced from the first groove; and a second pair of seal rings adjacent to each other in the second groove, each of the rings having a longitudinally extending slot; and means for preventing relative rotation between the rings for maintaining the slots in adjacent rings out of axial alignment with each other.

3. A ring seal packer as recited in claim 2 wherein the body has a uniform outside diameter and the first and second grooves are separated by a spacer sleeve between the pairs of seal rings, the inside of the spacer sleeve fitting around the outside diameter of the body between the rings.

4. A ring seal packer as recited in claim 1 further comprising a shear ring longitudinally below the seal rings for failing in the event a ring seal packer becomes stuck in a well.

5. A ring seal packer as recited in claim 1 wherein the means for preventing relative rotation between the seal rings is integral with the rings.

6. A ring seal packer as recited in claim 5 wherein the means for preventing relative rotation between the seal rings comprises a tang on one ring and a mating notch on the other ring.

7. A ring seal packer as recited in claim 1 wherein the clearance between the ends of the seal rings and the ends of the groove forms a radially extending fluid flow orifice having an area smaller than the transverse annular area between an inside surface of the ring and an outside surface of the body when the ring is installed in well tubing.

8. A ring seal packer as recited in claim 1 wherein the wall thickness of the seal rings is approximately the same as the depth of the groove.

9. A ring seal packer as recited in claim 1 wherein the inside diameter of each ring is sufficiently similar to the outside diameter of the body at the groove to prevent plastic yield of the ring upon radial collapse of the ring tightly into the groove.

10. A ring seal packer as recited in claim 1 wherein an end of the groove is formed by a sleeve fitted closely around the outside diameter of the body, and means for preventing the sleeve from moving axially on the body.

11. A ring seal packer for sealing a specified diameter of API tube comprising:

a cylindrical mandrel;

means at a top end of the mandrel for connecting the mandrel to a pipe;

at least one circumferential groove in the mandrel;

at least two rigid seal rings in such a groove, the two rings occupying substantially the full length of the groove, each of the rings having an outside diameter larger than the inside diameter of a specified API tube;

a longitudinal slot in each of the seal rings for permitting the ring to collapse to a diameter at least as small as the inside diameter of the specified tube; and means for keeping the slots in adjacent rings out of alignment with each other.

12. A ring seal packer as recited in claim 11 wherein the maximum longitudinal clearance between the rings and the groove is about ten mils.

13. A ring seal packer as recited in claim 11 further comprising:

a second circumferential groove longitudinally spaced from the first groove; and a second pair of seal rings in the second groove, the second rings occupying substantially the full length of the second groove, each of the rings having an outside diameter larger than the inside diameter of a specified API tube;

a longitudinal slot in each of the seal rings for permitting the ring to collapse to a diameter at least as small as the inside diameter of the specified tube; and means for keeping the slots in adjacent rings out of alignment with each other.

14. A ring seal packer as recited in claim 13 wherein the mandrel has a uniform outside diameter and the first and second grooves are formed by a spacer sleeve longitudinally between the pairs of seal rings, an inside surface of the spacer sleeve fitting closely around the outside diameter of the mandrel between the rings.

15. A ring seal packer as recited in claim 11 further comprising a shear ring below the seal rings for failing in the event a ring seal packer becomes stuck in a well.

16. A ring seal packer as recited in claim 11 wherein the diameter of a bottom of the groove plus twice the wall thickness of a ring is approximately the same as the drift diameter of the specified tube.

17. A ring seal packer as recited in claim 11 wherein the means for preventing relative rotation between the seal rings comprises a tang on one ring and a mating notch on the other ring.

18. A ring seal packer as recited in claim 11 wherein the longitudinal clearance between the seal rings and the grove provides a radially extending fluid flow orifice having an area smaller than the transverse annular area between the inside of the ring and bottom of the groove when the ring is installed in well tubing.

19. A ring seal packer as recited in claim 11 wherein the wall thickness of the seal rings is approximately the same as the depth of the groove.

20. A ring seal packer as recited in claim 11 wherein the slots in the two rings are approximately 180° from each other when the tang and notch are engaged.

21. A ring seal packer for sealing a specified diameter of API tube comprising:

a cylindrical steel body having means at an upper end for connecting the body to a pipe;

a plurality of grooves in the outside surface of the body;

a pair of rigid rings in each of the grooves, each ring having an outside diameter larger than the inside diameter of the specified tube and a wall thickness such that the sum of the ring thickness and the diameter of the body at the bottom of the groove is approximately the same as the drift diameter of the specified tube, each pair of rings collectively substantially filling the length of the respective groove;

a longitudinal slot in each of the rings for permitting the ring to collapse to a diameter smaller than the inside diameter of the specified tube; and a tang on one of the rings in a pair and a mating notch in the other of the rings in the pair for preventing relative rotation of the rings, the slots in the two rings being approximately 180° from each other when the tang and notch are engaged.

22. A ring seal packer as recited in claim 21 wherein the maximum longitudinal clearance between a pair of seal rings and the respective groove is about ten mils.

23. A ring seal packer comprising:

a tubular body;

a circumferential groove in an outside surface of the body;

a pair of rigid seal rings adjacent to each other in the groove, the sum of the lengths of the rings in the groove being substantially the same as the length of the groove;

a longitudinally extending slot in each of the rings; and means for preventing relative rotation between the rings for maintaining the slots in adjacent rings out of axial alignment with each other.

* * * * *